United States Patent [19]

Geary

[11] Patent Number: 4,643,668

[45] Date of Patent: Feb. 17, 1987

[54] HOT SURFACE DIRECT IGNITION SYSTEM FOR GAS FURNACES

[75] Inventor: Frederick J. Geary, Holland, Mich.

[73] Assignee: Robertshaw Controls Company, Richmond, Va.

[21] Appl. No.: 624,014

[22] Filed: Jun. 25, 1984

[51] Int. Cl.[4] ..... F23N 5/00

[52] U.S. Cl. ..... 431/70; 431/27; 431/78

[58] Field of Search ..... 431/27, 66, 67, 69, 431/70, 71, 78, 25, 6, 74, 49; 361/253, 264

[56] References Cited

U.S. PATENT DOCUMENTS

| | | | |
|---|---|---|---|
| 3,947,220 | 3/1976 | Dietz | 431/27 X |
| 4,190,414 | 2/1980 | Elmy | 431/67 X |
| 4,260,362 | 4/1981 | Matthews | 431/69 |
| 4,303,385 | 12/1981 | Rudich et al. | 431/70 |
| 4,325,689 | 4/1982 | Burke | 431/70 |
| 4,459,097 | 7/1984 | Riordan et al. | 431/69 X |

FOREIGN PATENT DOCUMENTS

| | | | |
|---|---|---|---|
| 1957920 | 6/1970 | Fed. Rep. of Germany | 431/70 |

*Primary Examiner*—Margaret A. Focarino
*Attorney, Agent, or Firm*—Candor, Candor & Tassone

[57] ABSTRACT

A low cost hot surface ignition system particularly adapted for use in gas furnaces and the like, the system including low voltage control and timing circuitry effective to control a gas valve and high voltage ignition circuitry incorporating a hot surface silicon carbide igniter disposed in the path of incoming gas and in the heat of the flame when ignition is achieved to effect flame rectification resulting in flame sensing. The system also provides fail-safe operation or safety shutdown of the associated furnace if ignition is not achieved or in the event of a failure of a component of the system.

21 Claims, 4 Drawing Figures

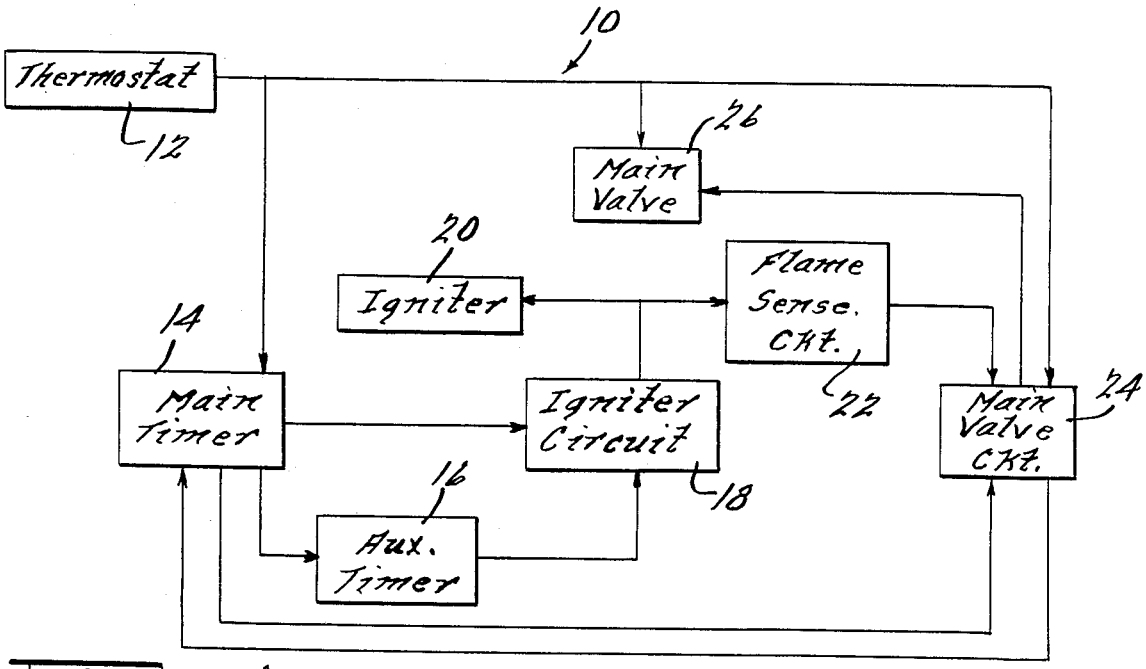
FIG. 1.
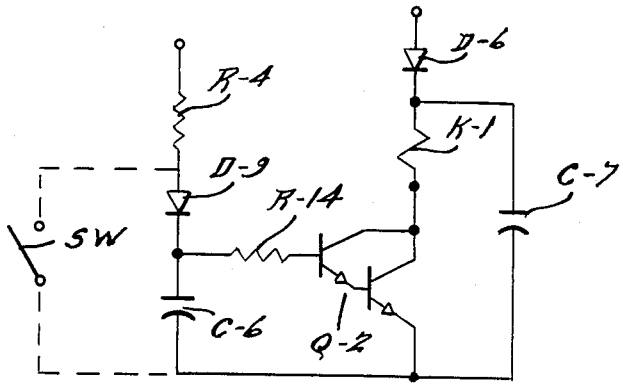
FIG. 3.
FIG. 4.
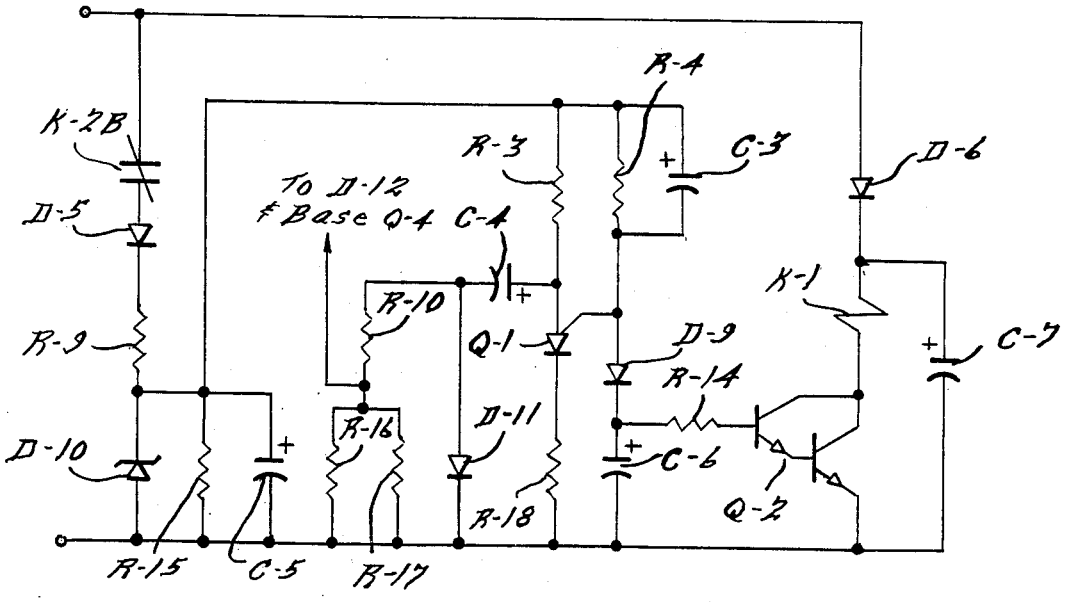

HOT SURFACE DIRECT IGNITION SYSTEM FOR GAS FURNACES

BRIEF SUMMARY OF THE INVENTION

This invention relates to ignition systems and, more particularly, to an improved hot surface direct ignition system particularly adapted for use in gas furnaces and the like.

Heretofore, numerous ignition systems have been utilized for the purpose of igniting either natural or manufactured gas utilized in gas furnaces for heating purposes, such ignition systems usually including a pilot flame and functioning under the control of a thermostat situated in an area which is to be heated by the furnace.

An object of the present invention is to reduce the cost of ignition systems of the indicated character, eliminate the need for a pilot flame, and at the same time provide an improved hot surface direct ignition system incorporating improved means for providing fail safe operation of the furnace in which the system is incorporated.

Another object of the present invention is to provide an improved ignition system incorporating hot surface ignition means effective to ignite directly natural or manufactured gas utilized in gas furnaces for heating purposes.

Another object of the present invention is to provide an improved hot surface direction ignition system incorporating improved low voltage control circuitry including unique, economical timing means and effective to control high voltage hot surface ignition circuitry incorporating hot surface direct ignition means effective to ignite natural or manufactured gas.

Another object of the present invention is to provide an improved hot surface direct ignition system for gas furnaces incorporating improved means which provides fail safe operation of safety shutdown of the furnace in the event of a failure of a component of the ignition system.

Another object of the present invention is to provide an improved hot surface direct ignition system incorporating improved means for retrying ignition in the event of a power failure or gas interruption and for effecting safety shutdown of the furnace if reignition is not effected.

Another object of the present invention is to provide an improved hot surface direct ignition system for gas furnaces incorporating improved means for attempting a single retry for ignition in the event power is momentarily removed or the flow of gas is interrupted during a normal heating cycle and for effecting shutdown of the flow of gas, if reignition is unsuccessful, until power is removed from the system for a predetermined period of time.

Another object of the present invention is to provide an improved hot surface direct ignition system for gas furnaces that may be readily adapted to meet the ignition requirements of a wide variety of gas furnaces.

The above as well as other objects and advantages of the present invention will become apparent from the following description, the appended claims and accompanying drawings.

BRIEF DESCRIPTION OF THE DRAWINGS

FIG. 1 is a schematic block diagram of a hot surface direct ignition system embodying the present invention;

FIG. 3 is a schematic diagram illustrating the circuitry for the igniter circuit and auxiliary timer blocks illustrated in FIG. 1;

FIG. 4 is a schematic diagram illustrating the programmable unijunction transistor timer circuitry portion of the system illustrated in FIG. 2.

DETAILED DESCRIPTION

Figure 2:
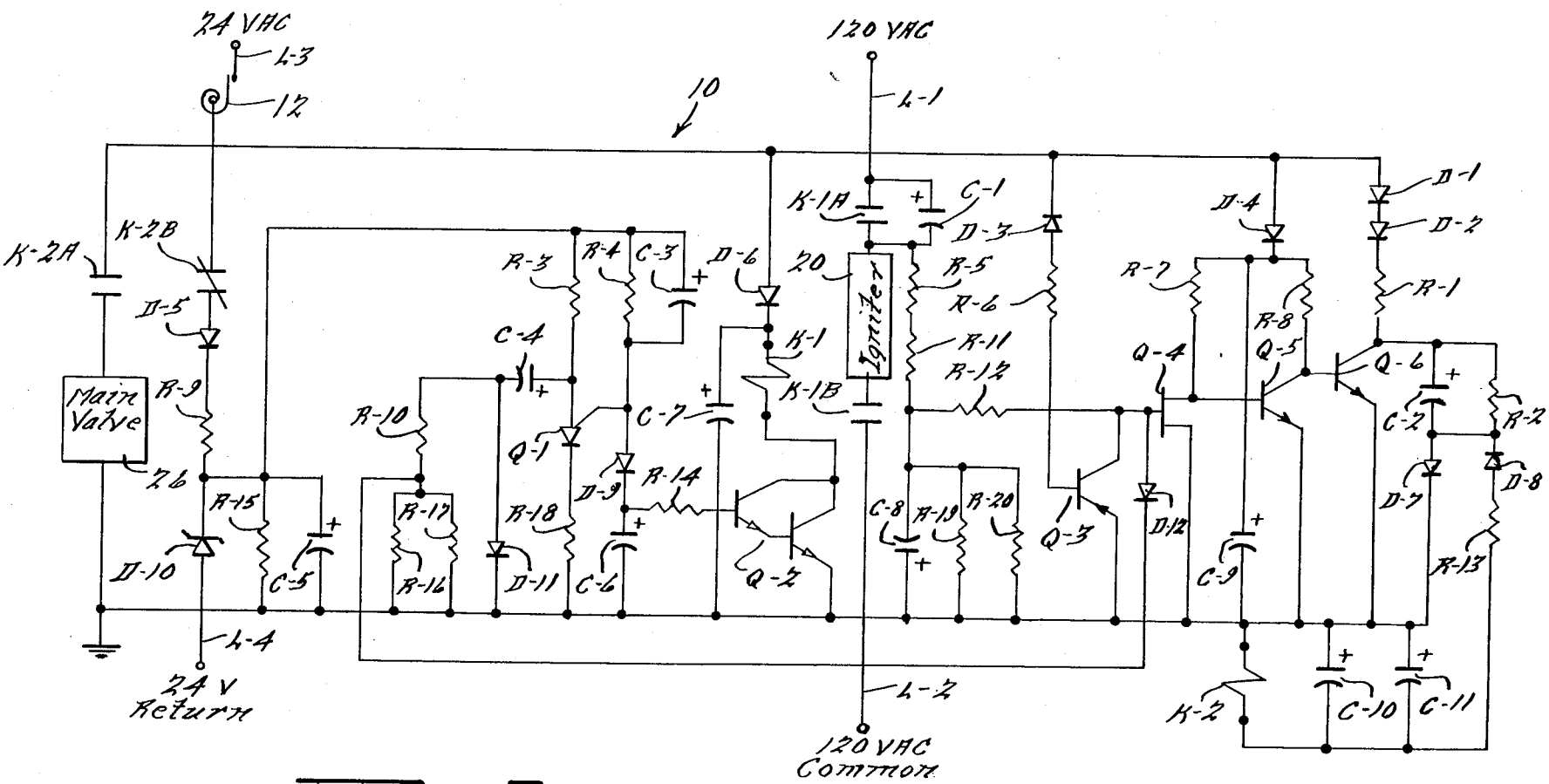
FIG. 2 is a schematic circuit diagram illustrating the circuitry for the system illustrated in FIG. 1.

Referring to the drawings, and more particularly to FIG. 1 thereof, a schematic block diagram of a hot surface direct ignition system, generally designated 10, embodying the present invention is illustrated therein. As shown in FIG. 1, the system 10 includes a conventional thermostat 12, a main timer circuit 14, an auxiliary timer circuit 16, an igniter circuit 18, a hot surface silicon carbide igniter 20 which is disposed in the path of incoming gas and in the flame when ignition is effected, a flame sensing circuit 22, a main valve control circuit 24, and a conventional main gas valve 26. The system 10 is adapted to provide control, supervision, ignition, automatic retry ignition in the event of combustion failure, and safety shutdown in the event reignition is not established.

The electrical circuitry for the system 10, illustrated in FIG. 1, is illustrated in FIGS. 2, 3 and 4. As shown in FIG. 2, in addition to the thermostat 12, the silicon carbide igniter 20 and the main gas valve 26, the system 10 includes a relay K-1 having normally open contacts K-1A and K-1B; a relay K-2 having normally open contacts K-2A and normally closed contacts K-2B; resistors R-1 through R-20; diodes D-1 through D-10; transistors Q-1 through Q-6; and capacitors C-1 through C-11, the above described components all being electrically connected by suitable conductors as illustrated in FIGS. 2, 3 and 4 and as will be described hereinafter in greater detail. As shown in FIG. 2, the system 10 is adapted to be connected to a conventional source of line voltage alternating current, such as 120 volts alternating current, by the leads L-1 and L-2, and the system 10 also includes low voltage control circuitry which includes the thermostat 12 and which is adapted to be connected, through the thermostat 12, to a source of low voltage alternating current, such as 24 volts alternating current, by the lead L-3 and to a low voltage return by the lead L-4.

In general, the system 10 operates in the following manner to perform three timing and two control functions. On closure of the contacts of the thermostat 12, the relay K-1 is energized thereby effecting closure of the contacts K-1A and K-1B and 120 volt AC current is supplied to the silicon carbide igniter 20 preferably for a minimum of approximately 40 seconds. The system 10 then causes the main gas valve 26 to be opened for approximately four seconds to initiate the flow of gas while simultaneously extending the igniter "on" time for an additional approximately two seconds into the valve trial for ignition time. The valve control is then relinquished to the flame sense circuit 22. If flame is present, the main gas valve 26 will be allowed to remain open. However, if ignition has not occurred, the main gas valve 26 will close at the end of the trial for ignition period and stop the flow of gas. This lockout condition can only be cancelled by power removal, i.e. opening of the contacts of the thermostat 12 for a minimum predetermined time. If in the normal heating cycle, power is momentarily removed, or gas flow is interrupted, the system 10 will attempt reignition one time, and if not successful, will revert to lockout.

As shown in FIGS. 2 and 4, the main timing is provided by a unique programmable unijunction transistor timing circuit that utilizes the main timing capacitor C-4 in both a charging and discharging mode to render the circuitry fail safe from an open or short capacitor, and at the same time reduce the number and cost of components required. The igniter circuit 18 and auxiliary timer circuit 16 are illustrated in FIGS. 2 and 3. The auxiliary timer 16 is an R-C discharge circuit and is provided in addition to the programmable unijunction transistor bias circuit. The igniter circuit 18 includes the double pole double throw relay K-1 to switch in or out the igniter 18 and the flame sense circuit 22. The relay K-1 is sourced with a rectified, filtered voltage, and controlled by the Darlington transistor Q-2 which is, in turn, controlled by the main timer circuit 14 and the auxiliary timer 16. On timing up, the main timer circuit 14 preferably times the hot surface igniter 20 for a minimum of approximately 40 seconds. On timing down, a signal is sent to the main valve circuit 24 for an approximately four second ignition trial. If ignition is successful, the flame sense circuit 22 supplies a signal to the main valve circuit 24 to hold the main gas valve 26 open and voltage is removed from the main timer circuit 14 to allow reset for a retry ignition, if such retry ignition becomes necessary. If ignition is not established within the trial period, even though voltage had been removed from the main timer circuit 14, lockout occurs. The reason that lockout occurs in that the discharge time constants of the programmable unijunction transistor circuitry are longer than the trial for ignition period and the programmable unijunction transistor circuitry is still latched upon reapplication of voltage. The resistors R-4 and R-14, the diode D-9, and the base emitter junction of the Darlington transistor Q-2 form the bias network for the programmable unijunction transistor main timer. The capacitor C-6 and the resistor R-14 form the auxiliary timer. When the programmable unijunction transistor Q-1 (represented by the switch SW in FIG. 3) breaks over, the capacitor C-6, blocked by the isolation diode D-9, must discharge through the resistor R-14 into the base of the Darlington transistor Q-2, delaying relay dropout. In the embodiment of the invention illustrated, the low voltage control circuitry is designed to operate over a voltage range of 18 volts AC minimum to 30 volts AC maximum and a temperature range of minus 40 degrees C to plus 85 degrees C.

The relay K-1 is supplied half wave AC voltage and therefore the capacitor C-7 is provided to sustain and maintain a DC voltage condition across the relay K-1. The voltage supplied to the programmable unijunction transistor timer and base circuit of the Darlington transistor Q-2 is derived from a half wave rectifier D-5, filtered by a single capacitor C-5, and regulated by the zener diode D-10, and utilizes the bleeder resistor R-15 to provide a discharge time to one volt preferably in approximately 18 seconds. The ripple voltage associated with the zener diode D-10, capacitor filter C-5, is decreased with a given size capacitor, as the zener operational current is decreased. This is the result of two conditions, one, with a larger series resistor (lower zener current), the capacitor cannot charge as close to or overshoot the peak (zener clamped) voltage as with a smaller resistor. Secondly, the zener diode D-10, operating closer to the knee, gives the capacitor less time to discharge through its relatively low impedance. This combination will reduce ripple voltage. Ripple voltage will increase as input voltage increases. The load current demanded by the programmable unijunction transistor/Darlington circuit plus the bleeder R-15 varies. Moreover, the filter capacitor C-5 performs a dual function. When the programmable unijunction transistor Q-1 times out and latches, it causes the main valve relay K-2 to energize. When the relay K-2 energizes, it removes power from the programmable unijunction transistor circuit by opening the contacts K-2B. The programmable unijunction transistor Q-1 must remain latched during the entire trial for ignition period so that in case ignition does not occur and the relay K-2 drops out, reapplying power to the programmable unijunction transistor Q-1, it is still latched on and does not allow retry. It only allows lockout. The only source of power to the programmable unijunction transistor during this cycle is the filter capacitor C-5. As the power supply voltage decreases, the programmable unijunction transistor anode, valley and gate current all decrease in proportion until the programmable unijunction transistor Q-1 reaches the limit of its holding current capabilities, at which time it reverts to the blocking state. It will be understood that the latching time must be greater than the trial for ignition time. In the embodiment of the invention illustrated and described, trial for ignition at room temperature will be approximately four seconds. The capacitor C-3 between the gate and source voltage allows the ripple voltage to modulate the gate and make the threshhold voltage of the programmable unijunction transistor to appear higher. The capacitor C-3 aids in circuit reset and initial turn on, to drive the gate higher in voltage than the anode. The capacitor C-3 also supplies maximum surge current to the Darlington transistor base to aid ignition operation. The time constant of the capacitor C-3 in parallel with the gate to supply resistor R-4 should be approximately the same as the filter capacitor load resistance time constant, as for example 3. 5 seconds. On start up or application of voltage to the timer, the gate voltage will be forced to the source value and will then bleed down to the voltage divider set value, as for example in approximately 1.5 seconds.

The initial function of the programmable unijunction transistor timer is to provide power source to the igniter 20. The main timing circuit provides the initial igniter timing, and an additional approximately two seconds timing is also provided so that the igniter will still be powered up when the gas valve is initially opened. This is accomplished by connecting the capacitor C-6 from ground to the junction of the isolation diode D-9 and the resistor R-14 of the programmable unijunction transistor biasing network. When the programmable uninjunction transistor Q-1 is timing, the capacitor C-6 charges to the bias voltage, and when the programmable unijunction transistor times out, it discharges through the resistor R-14 into the base of the Darlington transistor Q-2 causing the igniter relay K-1 to remain energized for an additional time.

In the system 10 there is a diode D-11 in series with the timing capacitor C-4 which allows the capacitor C-4 to charge, but prevents it from discharging directly through the programmable unijunction transistor Q-1, but instead forces it through additional resistance R-10, R-16, R-17 parallel to the diode D-11. The voltage developed across these resistors R-10, R-16, R-17 is negative with respect to ground. This voltage is routed to the field effect transistor Q-4 in the relay control circuit and causes the relay K-2 to become energized, thus closing the contacts K-2A and opening the gas valve . When the capacitor C-4 becomes discharged, the relay K-2 deenergizes. The effective field effect transistor pinch off voltage may be in the range from 1.64 to 3.64 volts and so long as the main timing capacitor C-4 applies a negative voltage above this pinch off value, the main valve will remain open. The system 10 is capable of generating a wide range of trial for ignition timing. In the system 10, the discharge path for the main timing capacitor C-4 is through two independent paths. The dominant path is through the series resistor R-10, the diode D-12 and the collector emitter junction of the transistor Q-3, and since the semiconductor junctions develop voltage across them, they may be viewed as equivalent resistances for purposes of timing. The secondary discharge path exists through the series resistor R-10 and the redundant parallel resistors R-16 and R-17. This secondary path is necessary because if at the instant of programmable unijunction transistor breakover (highest voltage across the capacitor C-4), the thermostat contacts are opened, the primary discharge path would be eliminated because the transistor Q-3 would not be operating. As a consequence the capacitor C-4 would maintain its charge, and either turn on the main valve for a trial period, without previous ignition timing, when the thermostat was released, or give a shortened igniter timing period. Both could result in nuisance lockout. To avoid this situation and to allow a specific thermostat reset time, the resistors from R-10 to ground are added to act as a bleeder for the capacitor C-4. Since this resistor now shares in valve timing, if it should fail in an open circuit mode, the valve trial for ignition period would increase. Placing a plurality of resistors in parallel reduces the percentage of time change versus the number of potential failures.

Another failure that could affect valve trial for ignition time is the opening of the power supply diode D-10. This would cause the capacitor C-4 to charge to a higher voltage because the threshhold voltage of the programmable unijunction transistor would now shift with input voltage. It would not cause much change in the igniter timing, but would increase both auxiliary time and valve trial for ignition time without adversely affecting the safety of the system.

The main valve circuit operates upon the principle of energy transfer. On one-half cycle, the capacitor C-2 charges to a predetermined voltage. On the next half cycle, this capacitor discharges into the relay K-2 and the sustaining capacitors C-10 and C-11 across the relay K-2. The energy imparted from the discharge capacitor C-2 into the relay K-2 and sustaining capacitors C-10 and C-11 is great enough to pull in and hold the relay K-2 until the next discharge cycle. To prevent relay shatter from occurring, the two sustaining capacitors C-10 and C-11 are placed across the relay coil so that if one opens the other will sustain the relay K-2.

The bleeder resistor R-2 is included across the discharge capacitor C-2 to eliminate a momentary pulse to the main valve on thermostat reset. This pulse, although too short to release gas, could increase valve wear and shorten its life.

In the operation of the system 10, when the thermostat 12 calls for heat, closure of the contacts of the thermostat 12 applies low voltage alternating current to the circuitry. There are four separate rectifier circuits that convert the AC voltage to positive DC voltage and one rectifier circuit that converts the AC voltage to a negative DC voltage. The DC voltage derived by the diode D-5 is filtered by the capacitor C-5, regulated by the zener diode D-10, and applied to the circuit of the programmable unijunction transistor Q-1 for timing, and to the Darlington transistor Q-2 for biasing. The transistor Q-2 is allowed to conduct and causes the relay K-1 to energize, the relay K-1 being supplied by the DC voltage from the diode D-6 and the capacitor C-7. When the relay K-1 is energized, the contacts K-1A and K-1B close and 120 volts AC current is applied to the igniter element 20, which may be a conventional silicon carbide igniter element, thereby causing it to heat and glow, and additionally shorting out the flame sensing capacitor C-1. Since direct current is applied to the circuit of the programmable unijunction transistor Q-1; the capacitor C-4 charges to a preset voltage level and causes the programmable unijunction transistor Q-1 to change from an open circuit to a short circuit. When this condition occurs, two timing periods are initiated. The first timing period is caused by the removal of voltage across the capacitor C-6 which then discharges into the Darlington transistor Q-2 through the resistor R-14. This extends the igniter "on" period for approximately two seconds after the gas valve has been opened, and insures that gas will find the igniter 20 at its hottest temperature optimum ignition condition. The second timing period is the trial for ignition period. When the capacitor C-4 changes the state of the programmable unijunction transistor Q-1, the capacitor C-4 is left with a voltage remaining across it due to the blocking action of the diode D-11. Since the programmable unijunction transistor Q-1 is essentially a short circuit, the capacitor C-4 will discharge through the transistor Q-1, the resistor R-10 and the parallel combination of the resistors R-16 and R-17 developing a negative voltage, with respect to ground, across the resistors R-16/R17. This negative voltage is applied through the isolation diode D-12 to the gate of the field effect transistor Q-4. When there is no voltage at the gate of the field effect transistor Q-4, the field effect transistor Q-4 is essentially a short circuit. When the transistor Q-4 has a negative voltage applied to its gate, commonly known as pinch off voltage, the field effect transistor Q-4 is an open circuit. The capacitor C-4 is applying a negative voltage to the gate of the transistor Q-4, making it an open circuit. However, during every negative half cycle of the AC voltage input, the transistor Q-3 conducts thereby removing this negative voltage and causing the transistor Q-4 to act as a short circuit. The transistor Q-4 goes from open circuit to short circuit as long as the capacitor C-4 supplies negative voltage to the gate of the transistor Q-4, or as long as any negative voltage is applied to the gate, such as that supplied by flame rectification. When the negative voltage is removed from the gate of the field effect transistor Q-4, the field effect transistor Q-4 reverts to a shorted state, whether or not the transistor Q-3 is alternately opening and shorting the gate to ground. Negative voltage is removed when the capacitor C-4 completes its discharge period (trial for ignition period) or if flame rectification is not present.

The field effect transistor Q-4 alternately opening and shorting in synchronism with the line voltage causes the transistor Q-5 and the transistor Q-6 to follow its action. This changing state allows the capacitor C-2 to charge through the diode D-7, the resistor R-1, the diode D-1 and the diode D-2 on the positive half cycle and discharge into the relay K-2, the capacitor C-10 and the capacitor C-11 through the transistor Q-6, the diode D-8 and the resistor R-13 on the negative half cycle. This causes the relay K-2 to be energized as long as negative voltage is applied to the gate of the field effect transistor Q-4. Energization of the relay K-2 effects closure of the normally open contacts K-2A thereby causing the main gas valve 26 to open. Energization of the relay K-2 also opens the normally closed contacts K-2B and removes the source of voltage to the programmable unijunction transistor Q-1 and the bias of the Darlington transistor Q-2.

Even though the voltage is removed from the programmable unijunction transistor Q-1, it is important to note that the programmable unijunction transistor Q-1 was in conduction (shorted) when this voltage was removed and the programmable unijunction transistor Q-1 will remain in this condition (latched) until the capacitors C-3, C-4 and C-5 have discharged. When the capacitors C-3, C-4 and C-5 have discharged, the programmable unijunction transistor Q-1 will again revert to an open condition as it was when the thermostat contacts were first closed. If the relay K-2 deenergizes before the capacitors C-3, C-4 and C-5 discharge, the relay K-2 would reapply voltage to the circuit of the transistor Q-1 while it was still shorted, causing the transistor Q-1 to remain shorted and not allowing it to recycle. This constitutes a lockout condition and can only be changed by removing voltage from the circuit by opening the contacts of the thermostat 12 until all of the capacitors have discharged. The time required to effect such discharge may be approximately 30 seconds under some conditions.

When the capacitor C-4 first caused the programmable unijunction transistor Q-1 to revert to a shorted state, the capacitor C-4 also caused the gas valve 26 to open through its action on the field effect transistor Q-4. The igniter 20 was caused to remain energized by the auxiliary timer for an additional approximately two seconds after main gas was released by opening of the gas valve to insure ignition. During this two second igniter extension, the flame sense capacitor C-1 was shorted, preventing any type of flame rectification from occurring.

When the relay K-1 is deenergized, the contacts K-1A and K-1B open thereby disconnecting the igniter 20 from the line voltage, and the capacitor C-1 becomes unshorted. The igniter itself, being exposed to the flame, becomes the flame sense probe. This, through the diode action caused by the flame impinging on the igniter 20 (flame rectification) causes the capacitor C-1 to transfer a negative voltage charge to the capacitor C-8. A negative voltage develops across the capacitor C-8 and is supplied to the gate of the field effect transistor Q-4 through the resistor R-12, causing the relay K-2 to remain energized and the contacts K-1A and K-1B to remain open. After the relay K-2 has been energized long enough for the capacitor C-5 to discharge, the programmable unijunction transistor Q-1 timing circuit unlatches, or rearms, and if a power or gas interruption occurs, the system will attempt a retry for ignition. If the retry for ignition is not successful, lockout will occur.

Typical values for the components of the system 10 described hereinabove are as follows, although it will be understood that these values may be varied depending upon the particular application of the principles of the present invention:

| SYMBOL | | | | DESCRIPTION |
|---|---|---|---|---|
| R-1 | 79 ohm | 7 W | 5% | Wire Wound |
| R-2 | 5.6K | ¼ W | 5% | Carbon film |
| R-3 | 430K | ¼ W | 2% | Carbon film |
| R-4 | 2.7 m | ¼ W | 2% | Carbon film |
| R-5 | 2.2 M | ¼ W | 5% | Carbon film |
| R-6 | 2.2K | ¼ W | 5% | Carbon film |
| R-7 | 39K | ¼ W | 5% | Carbon film |
| R-8 | 4.3K | ½ W | 5% | Carbon film |
| R-9 | 1K | ¼ W | 5% | Carbon film |
| R-10 | 12K | ¼ W | 5% | Carbon film |
| R-11 | 2.2 M | ¼ W | 5% | Carbon film |
| R-12 | 4.3 M | ¼ W | 2% | Carbon film |
| R-13 | 33 ohm | ¼ W | 5% | Carbon film |
| R-14 | 4.3 M | ¼ W | 2% | Carbon film |
| R-15 | 270K | ¼ W | 5% | Carbon film |
| R-16 | 240K | ¼ W | 5% | Carbon film |
| R-17 | 240K | ¼ W | 5% | Carbon film |
| R-18 | 470 hm | ¼ W | 5% | Carbon film |
| R-19 | 22 M | ¼ W | 5% | Carbon composition |
| R-20 | 22 M | ¼ W | 5% | Carbon composition |
| D-1 | IN4004 | | | Rectifier |
| D-2 | IN4004 | | | Rectifier |
| D-4 | IN4004 | | | Rectifier |
| D-6 | IN4004 | | | Rectifier |
| D-3 | IN4148 | | | Diode |
| D-5 | IN4148 | | | Diode |
| D-7 | IN4148 | | | Diode |
| D-8 | IN4148 | | | Diode |
| D-9 | IN4148 | | | Diode |
| D-11 | IN4148 | | | Diode |
| D-12 | IN4148 | | | Diode |
| D-10 | IN6008B | | | Zener Diode |
| Q-1 | 2N6028 | | | PUT |
| Q-2 | 2N5308 | | | Darlington Transistor |
| Q-3 | 2N2907 | | | PNP Transistor |
| Q-4 | 2N5639 | | | Field Effect Transistor |
| Q-5 | 2N2222A | | | NPN Transistor |
| Q-6 | MPS-W-01A | | | NPN PWR Transistor |
| K-1 | Relay, 24 VDC, DPDT | | | |

-continued

| SYMBOL | DESCRIPTION |
|---|---|
| K-2 | Relay, 12 VDC, SPDT |
| C-1 | .0068 MFD @ 400 VDC 10% |
| C-2 | 47 MFD @ 35 VDC 10% |
| C-3 | 1.5 MFD @ 50 VDC, Low Leakage, Nichicon # 50-U-KB-1.5-M |
| C-4 | 100 MFD @ 35 VDC 10% Low Leakage |
| C-5 | 47 MFD @ 50 VDC, Nichicon # U-LB-1H-470-M |
| C-6 | .15 MFD @ 63 VDC 10%, EVOX (Secor) Type SMMKO |
| C-7 | 33 MFD @ 50 VDC, Nichicon # U-LB-1H-330-M |
| C-8 | .068 MFD @ 250 VDC 10% |
| C-9 | 10 MFD @ 50 VDC 20% |
| C-10 | 6.8 MFD @ 50 VDC 20% |
| C-11 | 6.8 MFD @ 50 VDC 20% |

The flame sense circuitry operates on voltage and does not have to draw current, and is much more sensitive than prior known controls, and the system 10 provides fail safe operation or safety shutdown of the associated furnace in the event of a failure of a component of the system. The following tables depict possible failure modes of the various components of the system 10, the effects and consequences of such possible failures, and include remarks respecting particular components. In the columns designated "a" and "b", under the designation "Consequences", column "a" indicates the system will continue to operate within the timings specified and that in this event, failure of any one additional functioning part will cause the system or component to continue to operate within the timings specified or cause the system to interrupt flow of gas under its control, or the system will complete the cycle of operation and will fail to start or will lockout on the subsequent cycle. The designation column "b" indicates that the system will act to interrupt flow of gas under its control.

FAILURE MODES AND EFFECTS ANALYSIS

| COMPONENT | FAILURE MODE | EFFECT | CONSEQUENCES a | CONSEQUENCES b | REMARKS |
|---|---|---|---|---|---|
| R-1 | Open | Lockout | | X | |
| R-2 | Open | None | X | | Bleeder Resistor |
| | Short | Lockout | | X | |
| R-3 | Open | Lockout | | X | |
| | Short | Lockout | | X | |
| R-4 | Open | Lockout | | X | |
| | Short | Lockout | | X | |
| R-5 | Open | Lockout | | X | |
| | Short | None | X | | |
| R-6 | Open | Lockout | | X | |
| | Short | Lockout | | X | |
| R-7 | Open | Lockout | | X | |
| | Short | Lockout | | X | |
| R-8 | Open | Lockout | | X | |
| | Short | Lockout | | X | |
| R-9 | Open | Lockout | | X | |
| | Short | Lockout | | X | Destroys D-5 and D-10 |
| R-10 | Open | Lockout | | X | |
| | Short | Lockout | | X | |
| R-11 | Open | Lockout | | X | |
| | Short | None | X | | |
| R-5 & R-11 | Short | Lockout | | X | |
| R-12 | Open | Lockout | | X | |
| | Short | Lockout | | X | |
| R-13 | Open | Lockout | | X | |
| | Short | None | X | | Protects D-8 |
| R-14 | Open | Lockout | | X | |
| | Short | Lockout | | X | |
| R-15 | Open | None | X | | Bleeder Resistor |
| | Short | Lockout | | X | |
| R-16 | Open | Inc Lkout time | X | | 9% inc in time |
| | Short | Lockout | | X | |
| R-17 | Open | Inc Lkout time | X | | 9% inc in time |
| | Short | Lockout | | X | |
| R-16 & R-17 | Open | Inc Lkout time | X | | 21% inc in time |
| D-10 & R-16 | Open | Inc Lkout time | X | | 30.5% inc in time |
| D-10 & R-17 | Open | Inc Lkout time | X | | 30.5% inc in time |
| R-18 | Open | Lockout | | X | |
| | Short | None | X | | Protective Resis. |
| R-19 | Open | | X | | |
| | Short | Lockout | | X | |
| R-20 | Open | | X | | |
| | Short | Lockout | | X | |
| D-1 | Open | Lockout | | X | |
| | Short | None | X | | |
| D-2 | Open | Lockout | | X | |
| | Short | None | X | | |

-continued

FAILURE MODES AND EFFECTS ANALYSIS

| COMPONENT | FAILURE MODE | EFFECT | CONSEQUENCES a | CONSEQUENCES b | REMARKS |
|---|---|---|---|---|---|
| D-1 & D-2 | Short | None | X | | |
| D-3 | Open | Lockout | | X | |
| | Short | None | X | | Protects Q-3 |
| D-4 | Open | Lockout | | X | |
| | Short | Lockout | | X | |
| D-5 | Open | Lockout | | X | |
| | Short | Lockout | | X | |
| D-6 | Open | Lockout | | X | |
| | Short | Lockout | | X | Melds K-1, no flame sense |
| D-7 | Open | Lockout | | X | |
| | Short | Lockout | | X | |
| D-8 | Open | Lockout | | X | |
| | Short | None | X | | |
| D-9 | Open | Lockout | | X | |
| | Short | None | X | | No Aux Time |
| D-10 | Open | Inc Lkout time | X | | 18% inc in time |
| | Short | Lockout | | X | |
| D-11 | Open | None | X | | Dec lkout time |
| | Short | Lockout | | X | |
| D-12 | Open | Lockout | | X | No Flame Sense |
| | Short | Lockout | | X | No Flame Sense |
| C-1 | Open | Lockout | | X | No Flame Sense |
| | Short | Lockout | | X | No Flame Sense |
| C-2 | Open | Lockout | | X | |
| | Short | Lockout | | X | |
| C-3 | Open | None | X | | Therm Reset 4 Min. |
| | Short | Lockout | | X | Permanent ignition |
| C-4 | Open | Lockout | | X | |
| | Short | Lockout | | X | |
| C-5 | Open | Lockout | | X | |
| | Short | Lockout | | X | |
| C-6 | Open | None | X | | No Aux Time Ign. |
| | Short | Lockout | | X | |
| C-7 | Open | Lockout | | X | Buzz/No Ign |
| | Short | Lockout | | X | Destroys D-6 |
| C-8 | Open | Lockout | | X | No Flame Sense |
| | Short | Lockout | | X | No Flame Sense |
| C-9 | Open | Lockout | | X | |
| | Short | Lockout | | X | Destroys D-4 |
| C-10 | Open | None | X | | |
| | Short | Lockout | | X | |
| C-11 | Open | None | X | | |
| | Short | Lockout | | X | |
| C-10 & C-11 | Open | Lockout | | X | K-2 may Buzz |
| K-1 | Open | Lockout | | X | No Ign |
| | Short | Lockout | | X | Destroys Q-2 |
| K-2 | Open | Lockout | | X | |
| | Short | Lockout | | X | |
| Q-1 | | | | | |
| G-K | Open | Lockout | | X | |
| G-K | Short | Lockout | | X | |
| G-A | Open | Lockout | | X | |
| G-A | Short | Lockout | | X | |
| A-K | Open | Lockout | | X | |
| A-K | Short | Lockout | | X | |
| Q-2 | | | | | |
| B-E | Open | Lockout | | X | |
| B-E | Short | Lockout | | X | |
| B-C | Open | Lockout | | X | |
| B-C | Short | Lockout | | X | |
| C-E | Open | Lockout | | X | |
| C-E | Short | Lockout | | X | |
| Q-3 | | | | | |
| B-E | Open | Lockout | | X | |
| B-E | Short | Lockout | | X | |
| B-C | Open | Lockout | | X | |
| B-C | Short | Lockout | | X | |
| C-E | Open | Lockout | | X | |
| C-E | Short | Lockout | | X | |
| Q-4 | | | | | |
| G-S | Open | Lockout | | X | |
| G-S | Short | Lockout | | X | |
| G-D | Open | Lockout | | X | |
| G-D | Short | Lockout | | X | |
| D-S | Open | Lockout | | X | |
| D-S | Short | Lockout | | X | |

-continued

| FAILURE MODES AND EFFECTS ANALYSIS | | | | | |
|---|---|---|---|---|---|
| | FAILURE | | CONSEQUENCES | | |
| COMPONENT | MODE | EFFECT | a | b | REMARKS |
| Q-5 | | | | | |
| B-E | Open | Lockout | | X | |
| B-E | Short | Lockout | | X | |
| B-C | Open | Lockout | | X | |
| B-C | Short | Lockout | | X | |
| C-E | Open | Lockout | | X | |
| C-E | Short | Lockout | | X | |
| Q-6 | | | | | |
| B-E | Open | Lockout | | X | |
| B-E | Short | Lockout | | X | |
| B-C | Open | Lockout | | X | |
| B-C | Short | Lockout | | X | |
| C-E | Open | Lockout | | X | |
| C-E | Short | Lockout | | X | |

While a preferred embodiment of the invention has been illustrated and described, it will be understood that various changes and modifications may be made without departing from the spirit of the invention.

What is claimed is:

1. A hot surface direct ignition system for gas furnaces and the like, said system comprising, in combination, a high voltage circuit adapted to be connected to a source of high voltage AC current, said high voltage circuit including hot surface igniter means disposed in the path of incoming gas and being subjected to the heat of the gas flame when gas ignition is obtained whereby flame rectification is effected by said igniter means, a low voltage circuit adapted to be connected to a source of low voltage AC current, said low voltage circuit including thermostatic switch means controlling the energization of said low voltage circuit, an electrically operable gas valve, first relay means having contacts in said high voltage circuit controlling the energization of said igniter means, second relay means controlling the energization of said gas valve, said low voltage circuit also including first timing means controlling the energization of said first relay means, second timing means controlling the energization of said second relay means, and third timing means operable upon the energization of said second relay means for maintaining the energization of said first relay means and said igniter means for a predetermined period of time, flame sensing means including a first capacitor connected always in parallel across said first relay contacts and always in series with said igniter means and effective to maintain energization of said second relay means when gas ignition is obtained, said second relay means also having contacts in said low voltage circuit controlling the energization of said first, second and third timing means.

2. The combination as set forth in claim 1 including Darlington transistor means controlling the energization of said first relay means and field effect transistor means controlling the energization of said second relay means.

3. The combination as set forth in claim 2 including a programmable unijunction transistor controlling the energization of said Darlington transistor means and said field effect transistor means.

4. The combination as set forth in claim 3 including a second capacitor, said programmable unijunction transistor and said field effect transistor being connected to opposite sides of said second capacitor.

5. The combination as set forth in claim 4 including rectifier means converting the voltage derived from said low voltage source to DC voltage.

6. The combination as set forth in claim 5 including zener diode means regulating and additional capacitor means filtering the rectified DC voltage derived from said rectifier means.

7. A hot surface direct ignition system for gas furnaces and the like, said system comprising, in combination, a high voltage circuit adapted to be connected to a source of high voltage AC current, said high voltage circuit including hot surface igniter means disposed in the path of incoming gas and being subjected to the heat of the gas flame when gas ignition is obtained whereby flame rectification is effected by said igniter means, a flame sensing circuit including a first capacitor always connected in series with said igniter means, a low voltage control and timing circuit adapted to be connected to a source of low voltage AC current, said low voltage circuit including thermostatic switch means, an electrically operable gas valve and first relay means having contacts in said high voltage circuit always connected in parallel with said first capacitor and in series with said igniter means and controlling the energization of said igniter means, said low voltage circuit also including second relay means having normally open contacts controlling the energization of said gas valve and normally closed contacts controlling the application of low voltage AC current from said source to said low voltage control circuit, said low voltage circuit including sequentially operable first and second timing means controlling the energization of said first relay means, said second timing means being effective to extend the energization of said first relay means and said igniter means for a predetermined period of time subsequent to energization of said gas valve.

8. The combination as set forth in claim 7 including a Darlington transistor controlling the energization of said first relay means.

9. The combination as set forth in claim 8 including a programmable unijunction transistor controlling the energization of said Darlington transistor.

10. The combination as set forth in claim 7 including a field effect transistor controlling the energization of said second relay means.

11. The combination as set forth in claim 7 including rectifier means converting the voltage derived from said low voltage source to DC voltage.

12. The combination as set forth in claim 11 including zener diode means regulating the voltage derived from said rectifier means, and capacitor means filtering the voltage derived from said rectifier means.

13. The combination as set forth in claim 7, each of said timing means including capacitive-resistance means.

14. A hot surface direct ignition system for gas furnaces and the like, said system comprising, in combination, a high voltage circuit adapted to be connected to a source of high voltage AC current, said high voltage circuit including a silicon carbide hot surface igniter disposed in the path of incoming gas and being subjected to the heat of the gas flame when gas ignition is obtained whereby flame rectification is effected by said igniter, a first capacitor always connected in series with said igniter, a low voltage circuit adapted to be connected to a source of low voltage AC current, said low voltage circuit including thermostatic switch means controlling the energization of said low voltage circuit, electrically operable gas valve means and first and second relay means, said first relay means having contacts in said high voltage circuit always connected in parallel with said capacitor and in series with said igniter and controlling the energization of said igniter, said second relay means having normally open contacts controlling the energization of said gas valve and normally closed contacts controlling the application of low voltage current to said low voltage circuit, first timing means controlling the energization of said igniter for a predetermined period of time, second timing means effective to open said gas valve after said predetermined period of time to initiate the flow of gas, means for extending the energization of said igniter after the opening of said gas valve, and means for energizing said igniter means upon momentary interruption of power to said system.

15. The combination as set forth in claim 14 including means for energizing said igniter means in the event gas flow is momentarily interrupted.

16. The combination as set forth in claim 14 including a Darlington transistor controlling the energization of said first relay means and a field effect transistor controlling the energization of said second relay means.

17. The combination as set forth in claim 16 including a programmable unijunction transistor controlling the energization of said Darlington transistor and said field effect transistor.

18. The combination as set forth in claim 17 including a second capacitor controlling the conductivity of said programmable unijunction transistor and said field effect transistor.

19. The combination as set forth in claim 18 including rectifier means converting the voltage derived from said low voltage source to DC voltage.

20. The combination as set forth in claim 19 including zener diode means regulating the voltage derived from said rectifier means, and a third capacitor filtering the voltage derived from said rectifier means.

21. The combination as set forth in claim 14, said first and second timing means including capacitive-resistance means.

* * * * *